US006312290B1

(12) United States Patent
Belopolsky

(10) Patent No.: US 6,312,290 B1
(45) Date of Patent: Nov. 6, 2001

(54) HIGH SPEED IDC MODULAR JACK

(75) Inventor: Yakov Belopolsky, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/446,557

(22) PCT Filed: Jun. 10, 1998

(86) PCT No.: PCT/US98/11971

§ 371 Date: Dec. 22, 1999

§ 102(e) Date: Dec. 22, 1999

(87) PCT Pub. No.: WO98/59396

PCT Pub. Date: Dec. 30, 1998

Related U.S. Application Data

(60) Provisional application No. 60/050,482, filed on Jun. 23, 1997.

(51) Int. Cl.[7] ..... H01R 23/02
(52) U.S. Cl. ..... 439/676; 439/941
(58) Field of Search ..... 439/676, 404, 439/941

(56) References Cited

U.S. PATENT DOCUMENTS 4,533,199 8/1985 Feldberg .
5,586,914 12/1996 Foster, Jr. et al. .
5,599,209 2/1997 Belopolsky .
5,639,266 6/1997 Patel .
5,779,503 7/1998 Tremblay et al. .
5,938,479 * 8/1999 Paulson et al. ..... 439/941
5,941,734 * 8/1999 Ikeda et al. ..... 439/676

* cited by examiner

*Primary Examiner*—Neil Abrams
*Assistant Examiner*—Phuong K T Dinh
(74) *Attorney, Agent, or Firm*—Steven M. Reiss; M. Richard Page

(57) ABSTRACT

A high speed IDC modular jack with conductors grouped into a first group and a second group. The conductors in the first group are longer than the conductors in the second group and are located in a separate plane to reduce cross-talk. First and second conductors extend in a first plane (30) perpendicularly into this base section (12) adjacent its first end (14). The conductor then extends longitudinally through the base section (12) and extends perpendicularly into the angular section (22) in a second (32) and third plane (34) respectively. Third and fourth conductors extend in a fourth plane (36) perpendicularly into the base section (12) adjacent its second end (16) and then extend into the angular section (22) of an insulative member in the second (32) and third (34) plane respectively.

24 Claims, 12 Drawing Sheets

HIGH SPEED IDC MODULAR JACK

CROSS-REFERENCE TO RELATED APPLICATIONS

This application is the national stage of International Application PCT/US98/11071, filed on Jun. 10, 1998, which claims the benefit of U.S. Provisional Patent Application No. 60/050,482, filed on Jun. 23, 1997, both of which are herein incorporated by reference.

BACKGROUND OF THE INVENTION

1. Field of the Invention

The present invention relates to electrical connectors and more particularly to insulation displacement contact (IDC) modular jacks.

2. Brief Description of Prior Developments

Modular jacks are used in two broad categories of signal transmission: analog (voice) and digital (data) transmission. These categories can overlap somewhat since digital systems are used for voice transmission as well. Nevertheless, there is a significant difference in the amount of data transmitted by a system per second. A low speed system would ordinarily transmit from about 10 to 16 megabytes per second (Mbps), while a high speed system should be able to handle 144 Mbps or even higher data transfer speeds. Often, high speed installations are based on asynchronous transfer mode transmission and utilize shielded and unshielded twisted pair cables.

With recent increases in the speed of data transmission, requirements have become important for electrical connectors, in particular, with regard to the reduction or elimination of crosstalk. Crosstalk is a phenomena in which a part of the electromagnetic energy transmitted through one of multiple conductors in a connector causes electrical currents in the other conductors.

Another factor which must be considered is that the telecommunications industry has reached a high degree of standardization in modular jack design. Outlines and contact areas are essentially fixed and have to be interchangeable with other designs. It is, therefore, important that any novel modular jack allow with only minor modification, the use of conventional parts and tooling in its production and use.

There is, therefore, a need for a modular jack insert which will reduce or eliminate crosstalk in telecommunications equipment.

There is also a need for such a modular jack insert which can reduce or eliminate crosstalk and common mode interference which is interchangeable with prior art modular jacks and which may be manufactured using conventional parts and tooling.

SUMMARY OF THE INVENTION

A high speed IDC modular jack wherein wires are grouped into a first group and a second group and wherein the wires in the first group are longer then the wires in the second group and are in a separate plane from said wires in the second group such that cross talk is reduced. Also encompassed by the present invention is an insert for a modular jack which includes an insulative member having a base section having a first and second end and an angular section extending approximately perpendicularly from the base section. A first conductor extends in a first plane perpendicularly into this base section adjacent its first end. It then extends longitudinally through the base section and then extends perpendicularly into the angular section in a second plane. A second conductor extends in the first plane perpendicularly into the base section and then extends longitudinally through the base section and then extends perpendicularly into the angular section in a third plane. A third conductor extends in a fourth plane perpendicularly into the base section adjacent its second end and then extends into the angular section of the insulative member in the second plane. Preferably a fourth conductor also extends in the fourth plane perpendicularly into the angular section of the insulative member in the third plane.

BRIEF DESCRIPTION OF THE DRAWINGS

The high speed IDC modular jack of the present invention is further described with reference to the accompanying drawings.

DETAILED DESCRIPTION OF THE PREFERRED EMBODIMENTS

Figure 1:
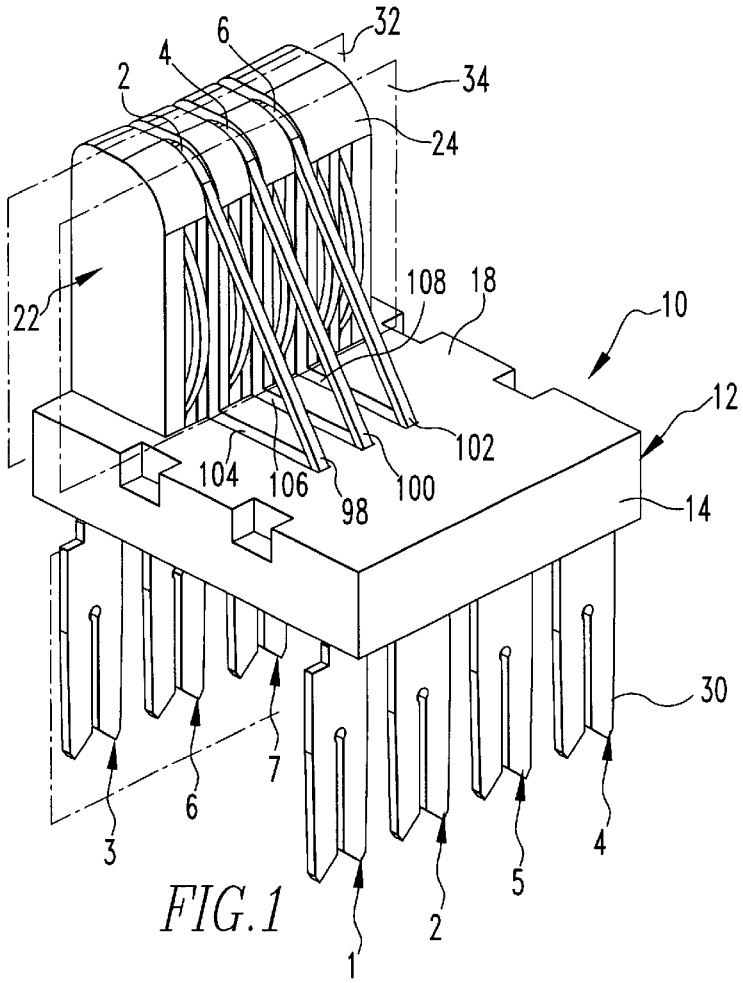
FIG. 1 is a top perspective view of a preferred embodiment of the modular jack insert of the present invention.

Referring to FIGS. 1–8, the insert is shown generally at numeral 10. The insert includes an insulative member which includes a base section 12 which has a first front end 14 and a second rear end 16. The base section also has a top interior side 18 and a bottom interior side 20. The insulative member also includes a vertical section 22 which has a front interior side 24, a rear exterior side 26 and an upper terminal end 28. Adjacent the front end 14 of the base section there are conductors 1, 2, 5, and 4 which have downwardly extending insulation displacement contacts. Adjacent the rear end 16 of the base section 12 there are conductors 3, 6, 7 and 8 which also have downwardly extending insulation displacements terminals. The first set of conductors extend upwardly in a first plane 30 (FIGS. 1, 3, 6 and 8) to enter the base section 12. These conductors extend rearwardly as is explained hereafter to adjacent the rear end 16 section of the base section. Some of these conductors extend in an upward vertical second plane 32 (FIGS. 1, 3, 6 and 8). Others extend in an upward vertical third plane 34 (FIGS. 1, 3, 6 and 8). There is also a downward vertical fourth plane 36 (FIGS. 1, 3, 6 and 8) in which the insulation displacement contacts of conductors 3, 6, 7 and 8 extend upwardly into the base section 12. In the base section 12 the conductor 1 includes a rearward extension shown generally at 38. Conductor 2 includes a rearward extension shown generally at conductor 40. Conductor 5 includes a rearward extension shown generally at 42. Conductor 4 includes a rearward extension shown generally at numeral 44. The rearward extension 38 of conductor 1 includes an initial longitudinal section 46 after which there is a transverse section 48 and then another section 50. The rearward extension 40 of the conductor 2 includes a longitudinal section 52, a transverse section 54 and another longitudinal section 56, another transverse section 58 and a longitudinal section 60. The rearward extension 42 of conductor 5 included a longitudinal section 62, a transverse section 64, another longitudinal section 66, another transverse section 68 and a longitudinal section 70. The rearward extension 44 conductor 4 includes a longitudinal section 72, a transverse section 74, a longitudinal section 76, and another transverse section 78.

Figure 2:
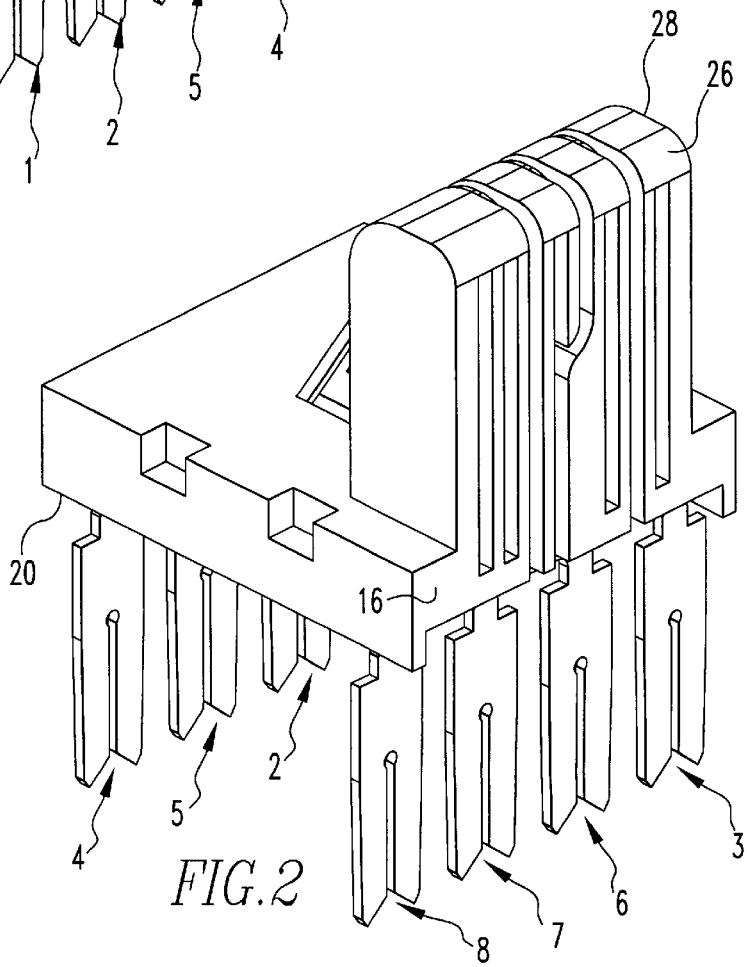
FIG. 2 is a bottom perspective view of the modular jack insert shown in FIG. 1.
Figure 3:
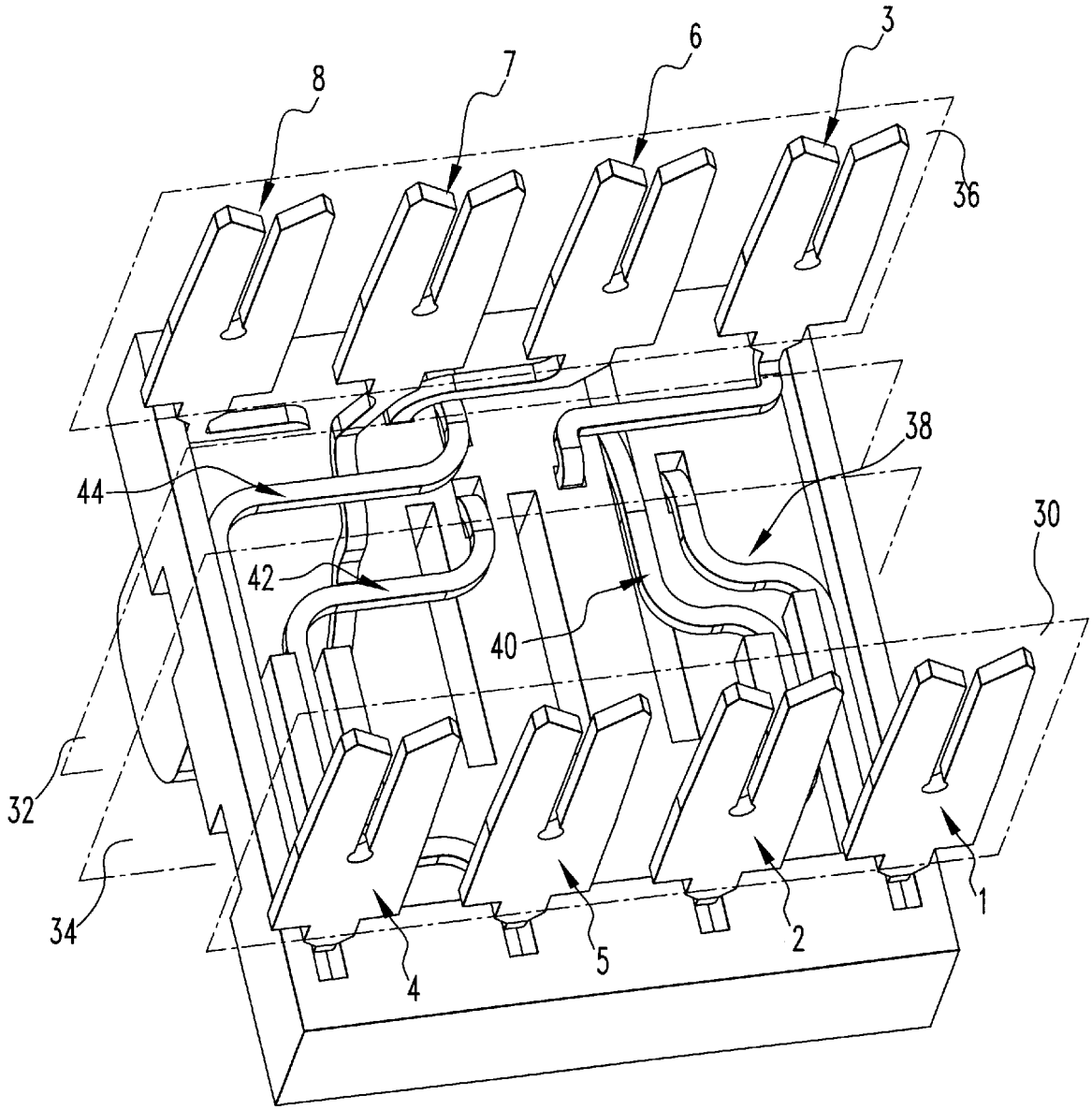
FIG. 3 is a bottom perspective rear of the modular jack insert shown in FIG. 1.
Figure 5:
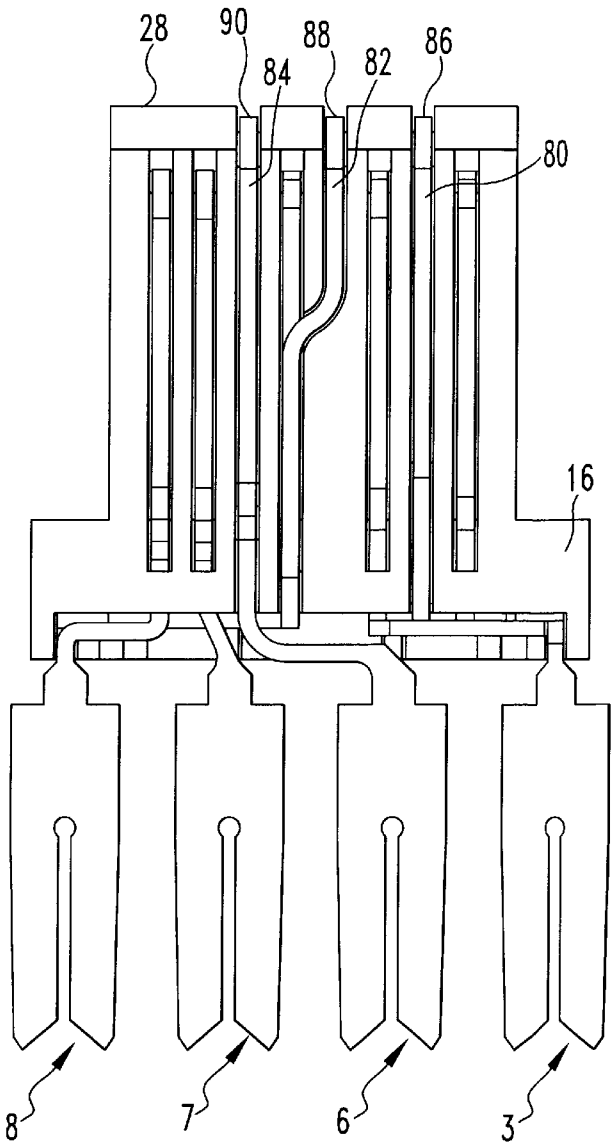
FIG. 5 is a rear elevational view of the modular jack insert shown in FIG. 4.
Figure 4:
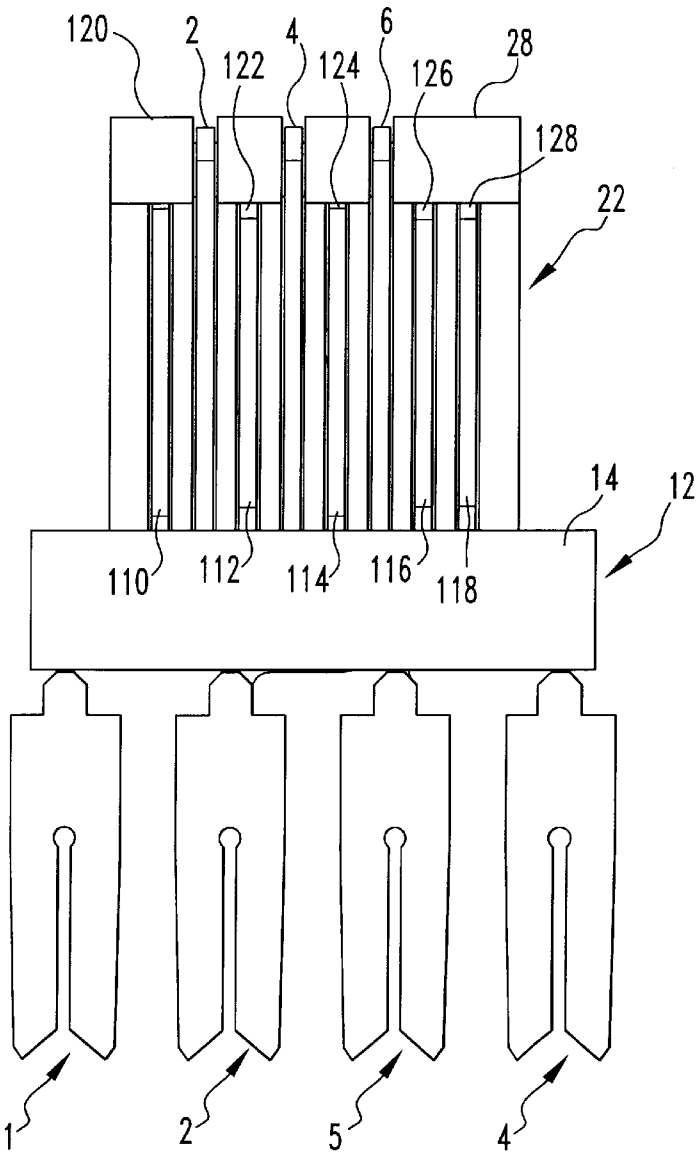
FIG. 4 is a front elevational view of the modular jack insert shown in FIG. 1.
Figure 6:
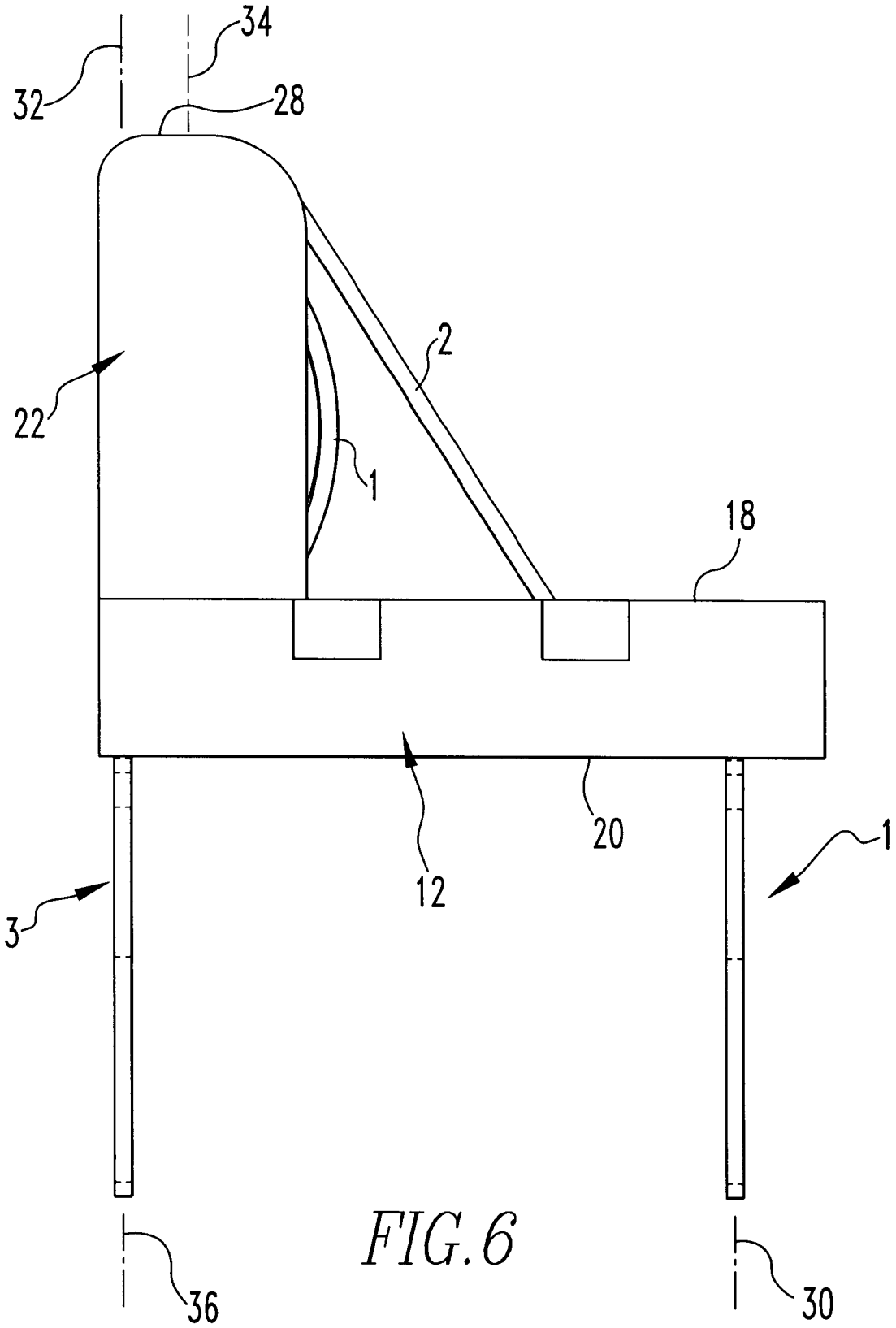
FIG. 6 is a side elevational view of the modular insert shown in FIG. 1.
Figure 7:
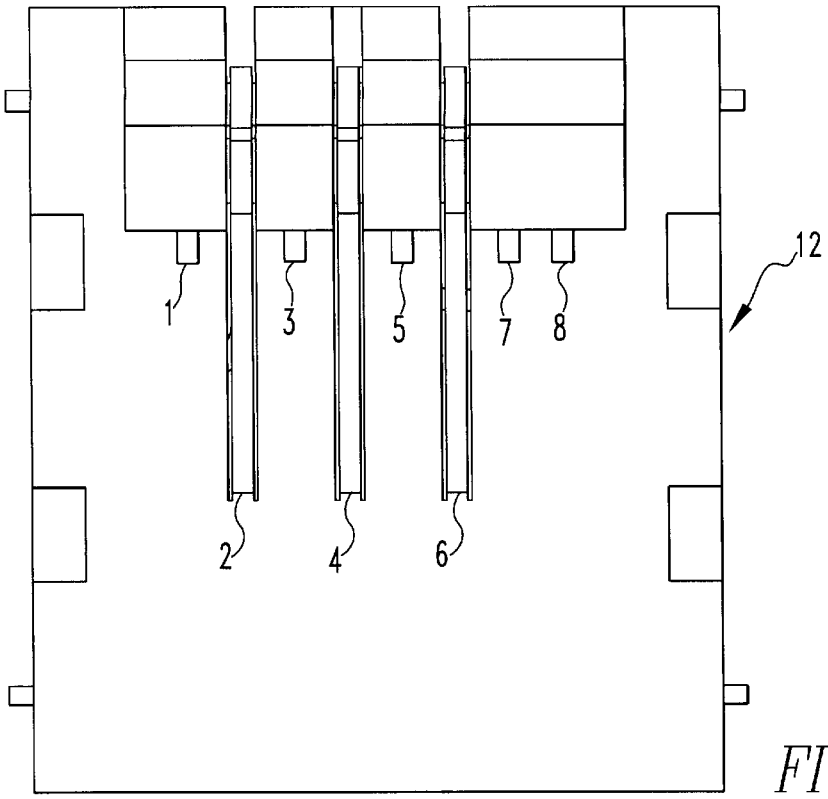
FIG. 7 is a top plan view of the modular jack insert shown in FIG. 1.
Figure 8:
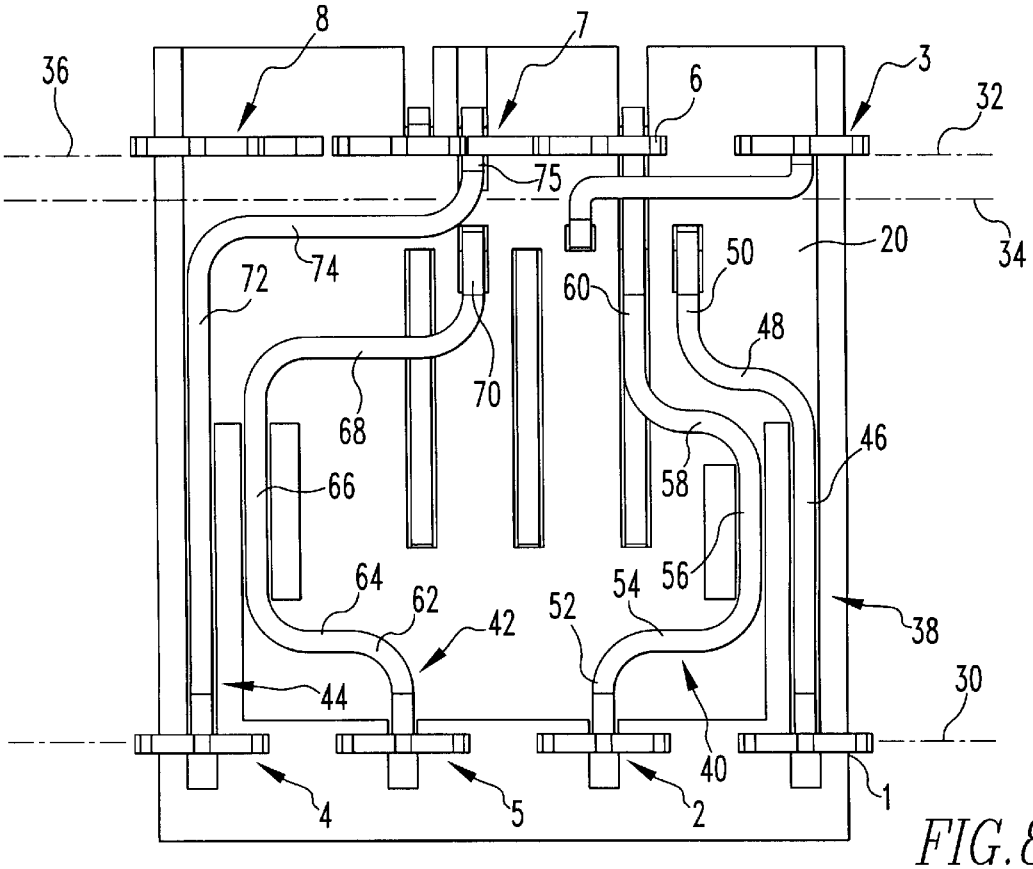
FIG. 8 is a bottom plan view of the modular jack insert shown in FIG. 1.
Figure 15:
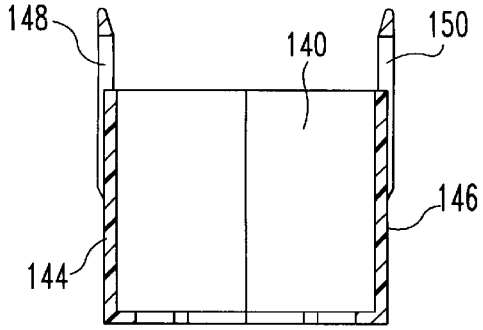
FIG. 15 is a cross sectional view through 15—15 in FIG. 9.
Figure 10:
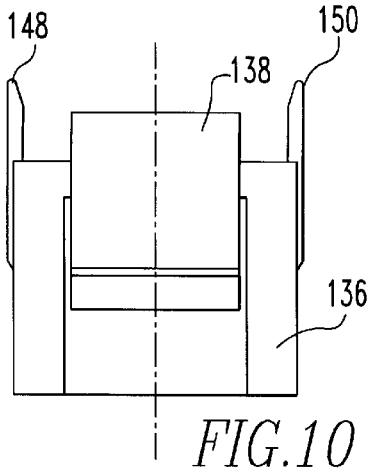
FIG. 10 is a top plan view of the cover section shown in FIG. 9.
Figure 14:
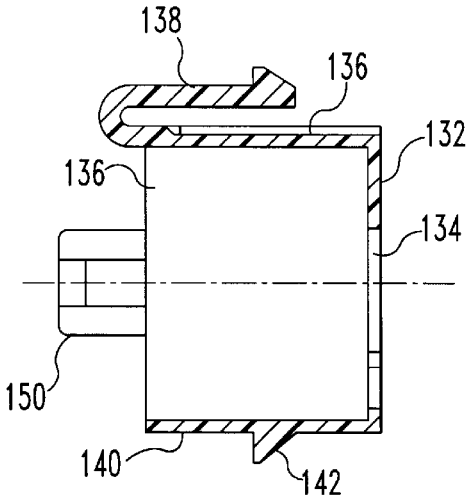
FIG. 14 is a cross sectional view through 14—14 in FIG. 9.
Figure 9:
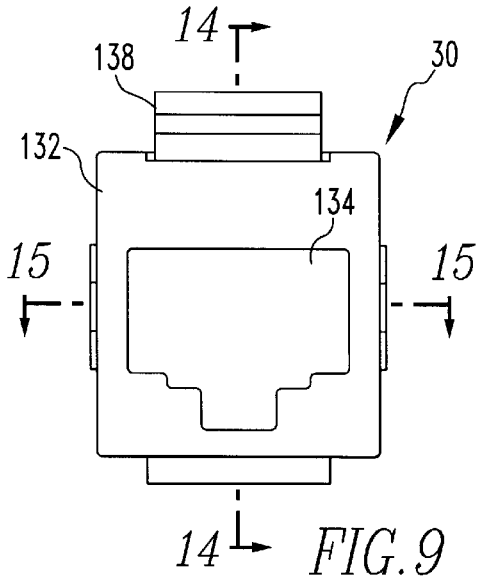
FIG. 9 is a front elevational view of the top cover section of the modular connector of the present invention.
Figure 11:
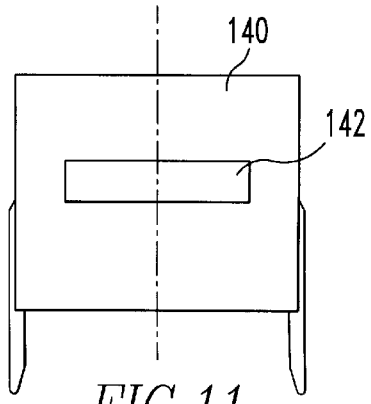
FIG. 11 is a bottom plan view of the cover section shown in FIG. 9.
Figure 12:
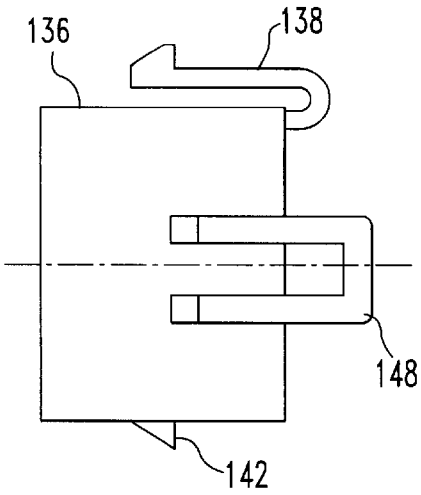
FIG. 12 is a side elevational view of the cover section shown in FIG. 9.
Figure 13:
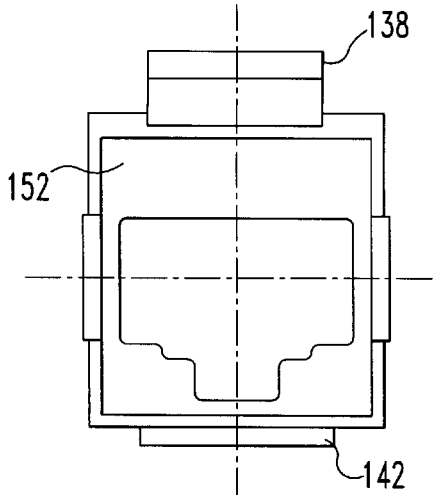
FIG. 13 is a rear elevational view of the cover section shown in FIG. 9.
Figure 21:
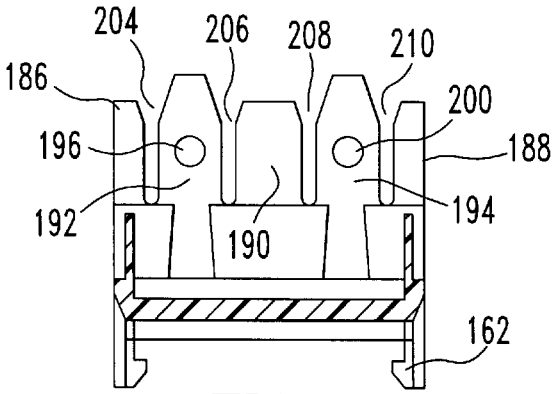
FIG. 21 is a cross sectional view through 21—21 in FIG. 16.
Figure 17:
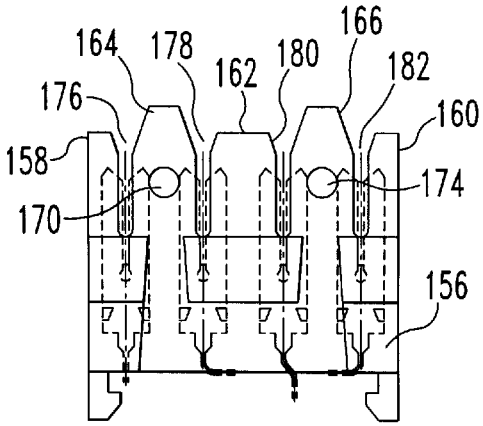
FIG. 17 is top plan view of the insert housing section shown in FIG. 16.
Figure 20:
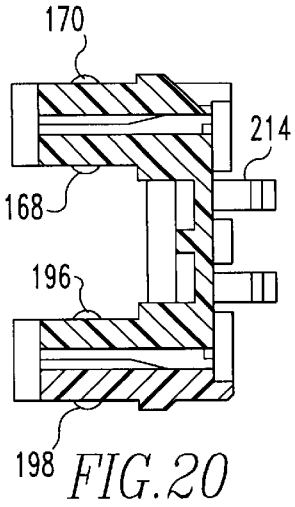
FIG. 20 is a cross sectional view through 20—20 in FIG. 16.
Figure 16:
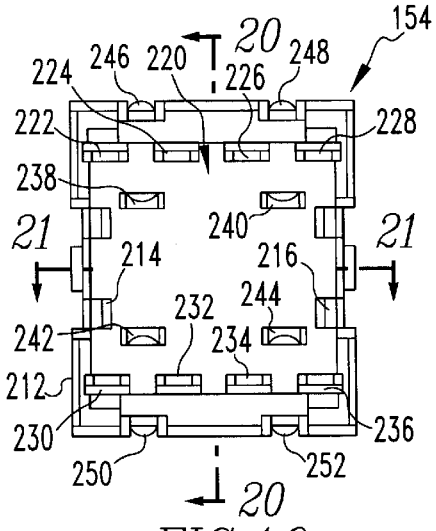
FIG. 16 is a bottom plan view of the rear housing section of the modular connector of the present invention.
Figure 19:
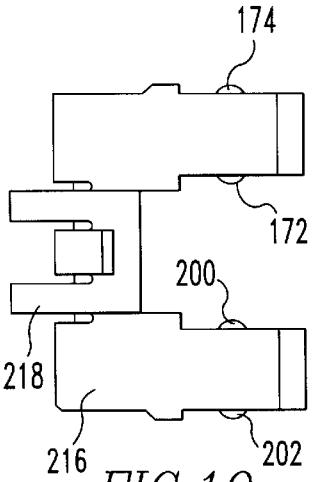
FIG. 19 is a side elevational view of the insert housing section shown in FIG. 16.
Figure 18:
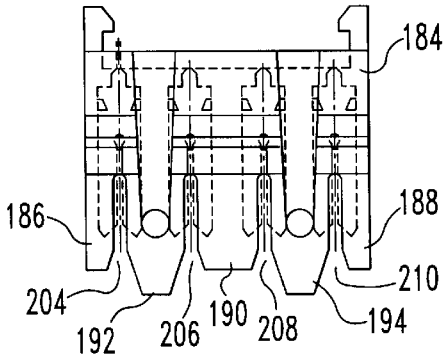
FIG. 18 is a bottom plan view of the insert housing section shown in FIG. 16.
Figure 23:
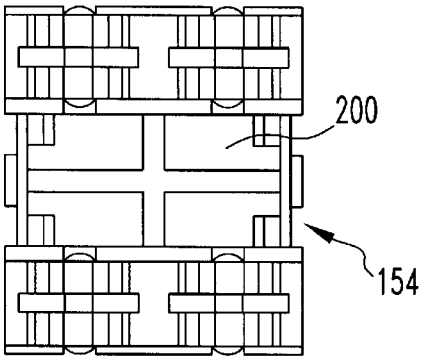
FIG. 23 is a bottom plan view of the IDC modular jack shown in FIG. 22.
Figure 22:
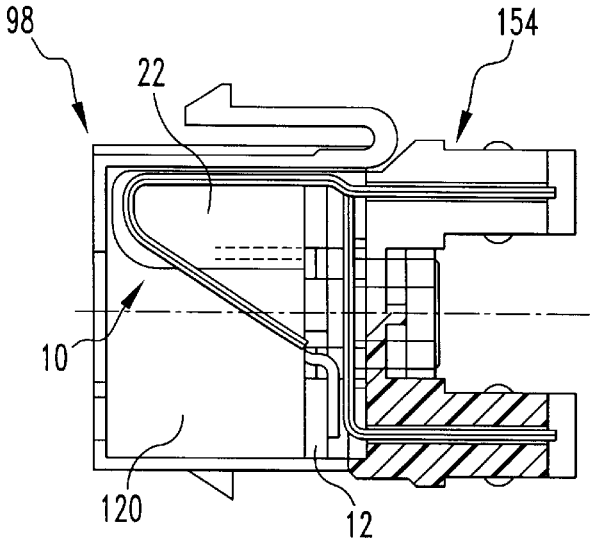
FIG. 22 is a cross sectional side elevational view of the IDC modular jack of the present invention.
Figure 24:
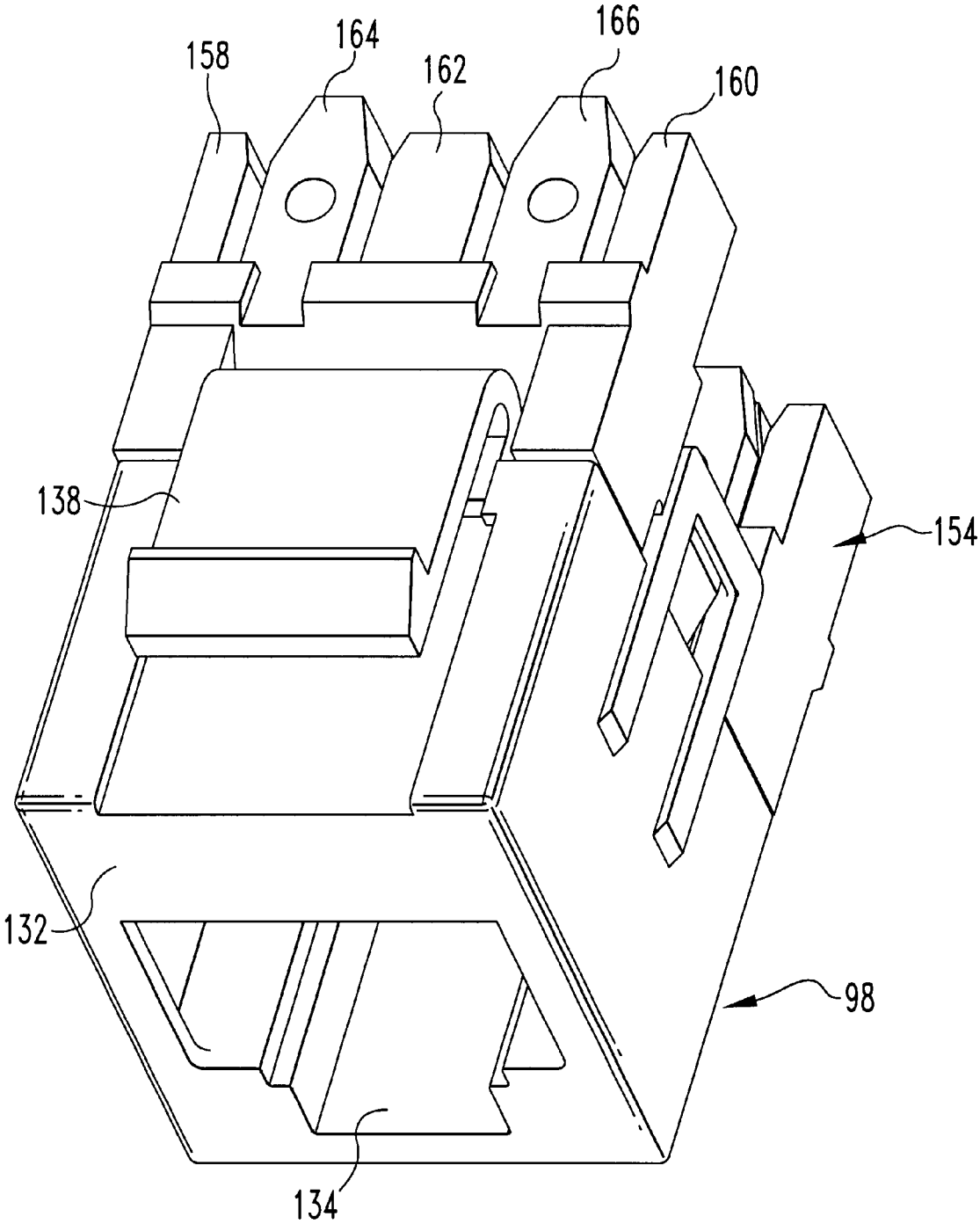
FIG. 24 is a top front perspective view of the IDC modular jack shown in FIG. 22.
Figure 26:
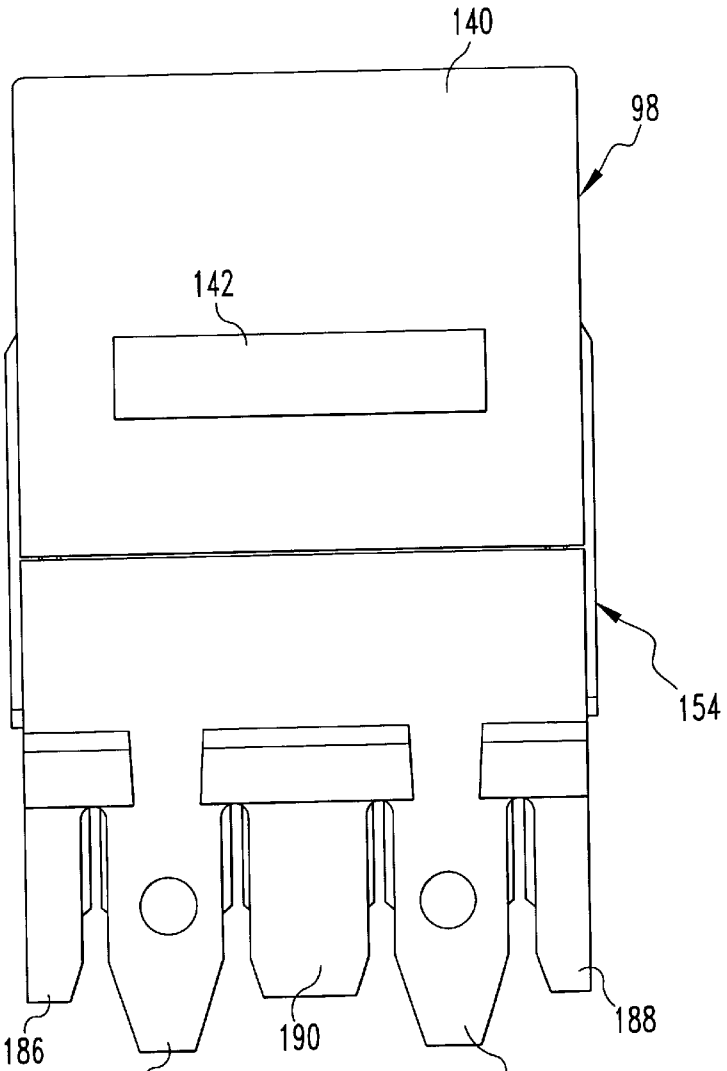
FIG. 26 is a bottom plan view of the IDC modular jack shown in FIG. 24.
Figure 25:
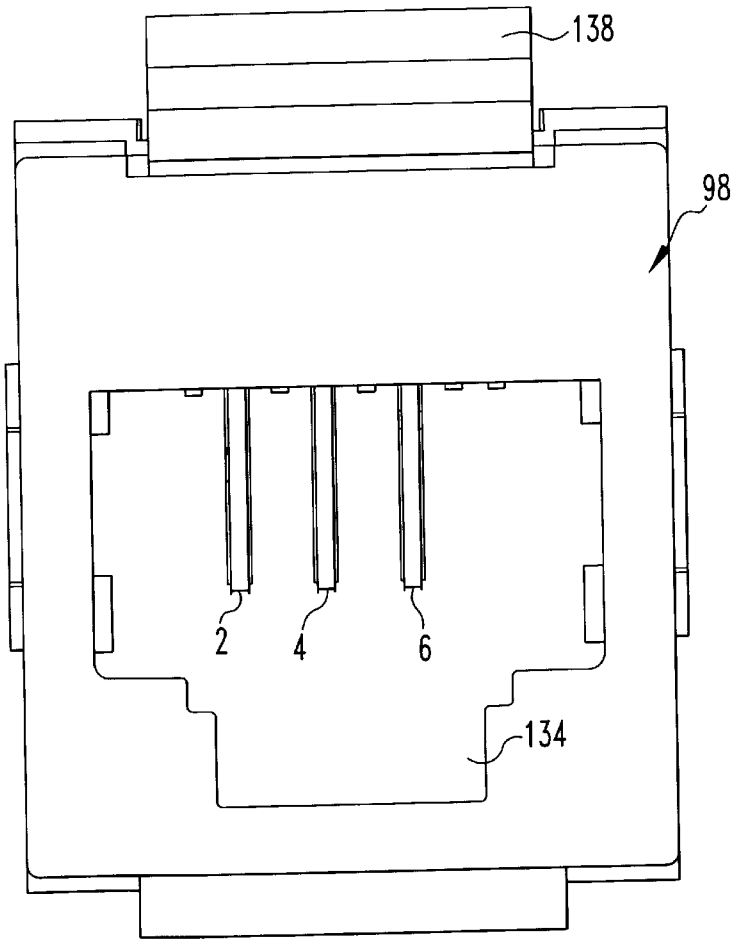
FIG. 25 is a front elevational view of the IDC modular jack shown in FIG. 24.

Referring particularly to FIG. 2, conductor 1 extends upwardly in the second plane in the vertical section of the insulative insert in upward section 80. Conductor 3 extends upwardly in the second plane in the upward extension 82. Conductor 5 extends upwardly in the second plane in upward extension 84. The upward extensions 80, 82 and 84 are contained respectively in vertical grooves 86, 88 and 90. It will be noted that groove 88 conveys conductor 3 extension 82 and a vertical section 92 an oblique section 94 and another section 92.

Referring particularly to FIG. 1, adjacent the upper terminal end 28, conductor 1 terminates in an oblique section 98, conductor 3 terminates in oblique section 100 and conductor 5 terminates in oblique section 102. These oblique sections are superimposed respectively over grooves 104, 106 and 108 in the vertical section 22. The other conductors extend vertically in the third plane in arcuate vertical sections 110, 112, 114, 116 and 118. These arcuate vertical sections are housed respectively in slots 120, 122, 124, 126 and 128.

It will be appreciated from the above disclosure that the first plane preferably includes contacts 1, 2, 5 and 4. The second plane preferably includes terminals 2, 4 and 6. The third preferably includes terminals 1, 3, 5, 7 and 8. The fourth plane preferably includes contacts 3, 6, 7 and 8.

It will also be appreciated that the above described insert has the following additional characteristics:

The wires are divided into two groups in the upper part of the vertical section of the insert. Wires 2, 4 and 6 are longer than wires 1, 3, 5, 6, 7 and 8. Wire 4 in the second plane overlays wire 5 in the third plane without crossing it and stays in the same plane. The positions of the wires 4 and 5 in the first plane are reversed. Differential spaces are kept together as specified as in EIA/TIA658SD. The long and short terminals are located in the same planes.

Referring to FIGS. 9–15, a cover section for the modular jack is shown generally at numeral 98. This cover section includes a front wall 100 which has a conventional plug receiving opening 102. The cover also has a top wall 104 having a top latch 106 and 1 bottom wall 108 having a stock 110. There are also cover sidewalls 112 and 114 which have respectively side latches 116 and 118. In opposed relation to the front wall 100 and the plug receiving opening 102, there is a rear opening 120.

Referring to FIGS. 16–21, the insert housing which forms another part of the IDC modular jack is shown generally at numeral 122. The insert housing has an upper side wall 124 which has opposed outer legs 126 and 128, a center leg 130 and intermediate legs 132 and 134 which are interposed respectively between the outer legs 126 and 128 and the center leg 130. On the intermediate leg 132 which has an inner and outer identity protrusion 136 and 138 which may be colored to identify the location of a particular wire. The intermediate leg 134 also has an inner and outer identity protrusion 140 and 142 which may also have a different color to identify a different wire. Between the above described legs there are formed wire receiving grooves 144, 146, 148 and 150. These receiving grooves are positioned so as to be centered over insulation displacement contacts on the insert which are shown in phantom lines. The insert housing also includes a bottom side wall 152 which is similar to the above described top side wall 124. That is, it has outer legs 154, 156, a center leg 158 and intermediate legs 160 and 162. There are inner and outer identity protrusions 164 and 166 on intermediate leg 160 and identity protrusions 168 and 170 on intermediate leg 162. There are also wire receiving grooves 172, 174, 176 and 178 which are superimposed over insulation displacement contacts shown in phantom. The insert housing also has a lateral wall 180 which has a latch 182 and an opposed lateral wall 184 which has a latch 186. The insert also has a rearward base wall 188. This base wall has a plurality of IDC contact receiving apertures 190, 192, 194, 196, 198, 200, 202 and 204. The base wall also has a plurality of protrusion exposing apertures 206, 208, 210 and 212. The base wall also has a plurality of protrusion exposing recesses 214, 216, 218 and 220.

Referring to FIGS. 22–26, an IDC modular jack is shown which is comprised of the integrated cover 98, insert 10 and insert housing 122. The vertical section 22 of the insert 10 passes through the rear opening 120 of the cover 98. The base section 12 of the insert 10 is superimposed on the base wall 188 of the insert housing 122. The insulation displacement contacts of the insert pass through the contact receiving apertures in the base wall of the insert housing.

The invention is further described with reference to the following example in which further embodiments of the invention are described.

EXAMPLE

Figure 27:
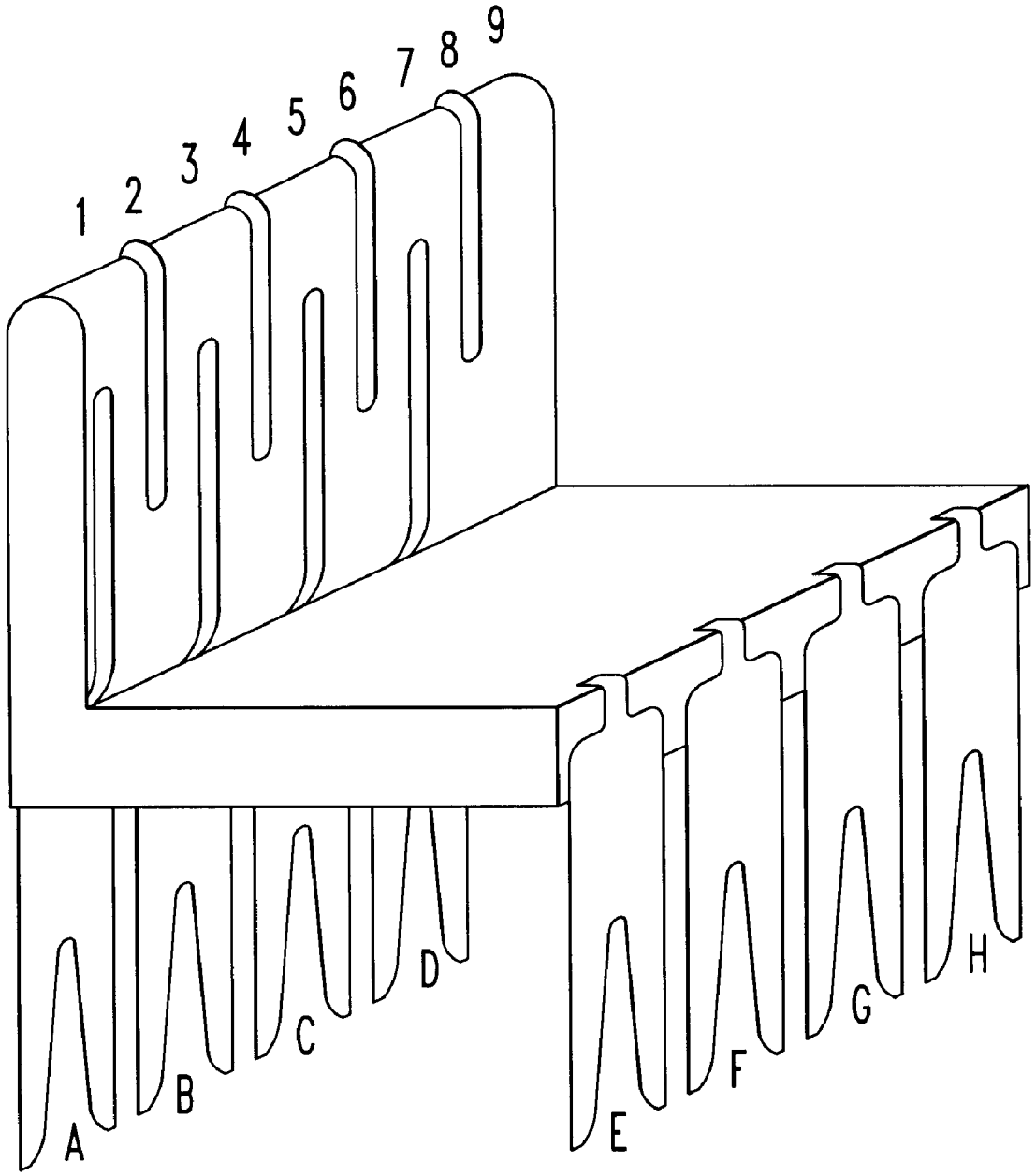
FIG. 27 is a perspective schematic view of the insert used in the of comparative tests hereafter described.

Referring to FIG. 27, 19 inserts (numbered 1–19) were made with various combinations of contacts as is described in Table I. In explanation of FIG. 27, contacts E, F, G and H are in the first plane as was described above. Terminals 2, 4, 6 and 8 are in the second plane as was described above. Terminals, 1, 3, 5 and 7 are in the third plane as is described above. Contacts A, B, C and D were in the fourth plane as described above. The number "0" in Table I means that the particular jack described did not make use of a contact in that position. Contacts were fitted with insulative covers and insert housings to make modular jacks in the way described above. Cross talk between contacts in the jacks was measured and is recorded in Table I.

TABLE I

| | POSITIONS | | | | | | | | CROSSTALK (-db) | | | | | |
|---|---|---|---|---|---|---|---|---|---|---|---|---|---|---|
| # | A | B | C | D | E | F | G | H | ½–3/6 | ½–4/5 | ½–⅞ | 3/6–4/5 | 3/6–⅞ | 4/5–⅞ |
| 1) | 4 | 5 | 7 | 8 | 1 | 2 | 3 | 6 | 40.6 | 45.6 | 64 | 46.2 | 39.8 | 50 |
| 2) | 4 | 5 | 7 | 8 | 1 | 2 | 3 | 6 | 56.3 | 41.7 | 59.1 | 42.8 | 39.0 | 52 |
| 3) | 4 | 5 | 7 | 8 | 1 | 2 | 3 | 6 | 52.1 | 40.6 | 54.1 | 45.3 | 54.3 | 45 |
| 4) | 3 | 6 | 0 | 0 | 1 | 2 | 4 | 5 | 46.2 | 34.4 | — | 47.5 | — | — |
| 5) | 3 | 6 | 7 | 8 | 1 | 2 | 5 | 4 | 42.3 | 49.8 | 53.8 | 38.1 | 39.5 | 59 |
| 6) | 5 | 4 | 7 | 8 | 1 | 2 | 3 | 6 | 46.8 | 39.4 | 50.5 | 42.5 | 34.8 | 41 |
| 7) | 5 | 4 | 7 | 8 | 1 | 2 | 3 | 6 | 46.5 | 39.6 | 59.4 | 42.1 | 38.3 | 46 |
| 8) | 2 | 5 | 4 | 7 | 1 | 3 | 6 | 8 | 12.6 | 35.3 | 69.7 | 20.2 | 44.4 | 59 |
| 9) | 3 | 6 | 7 | 8 | 1 | 2 | 5 | 4 | 49 | 44 | 63 | 47 | 55 | 40 |
| 10) | 5 | 4 | 7 | 8 | 0 | 0 | 0 | 0 | — | — | — | — | — | 45 |
| 11) | 4 | 5 | 7 | 8 | 0 | 0 | 3 | 6 | — | — | — | 45.2 | 50 | 39 |
| 12) | 4 | 5 | 7 | 8 | 1 | 2 | 3 | 6 | 56 | 41 | 59 | 42 | 39 | 58 |
| 13) | 3 | 6 | 0 | 0 | 1 | 2 | 4 | 5 | 46 | 39 | — | 46 | — | — |
| 14) | 1 | 2 | 7 | 8 | 4 | 5 | 3 | 6 | | — | — | 47.4 | 51.2 | 40.2 |
| 15) | 3 | 6 | 7 | 8 | 1 | 2 | 5 | 4 | 51.4 | 41.7 | 56.8 | 45.9 | 44.9 | 46.7 |
| 16) | 3 | 6 | 7 | 8 | 1 | 2 | 5 | 4 | — | 44.1 | — | 47.6 | 52.7 | 38.9 |
| 17) | 3 | 6 | 7 | 8 | 1 | 2 | 5 | 4 | 51.0 | 42.44 | 60.3 | 45.5 | 53.8 | 38.9 |
| 18) | 3 | 6 | 7 | 8 | 1 | 2 | 5 | 4 | 52.2 | 42.2 | — | 47.5 | 36.4 | 57.0 |
| 19) | 1 | 2 | 3 | 6 | 4 | 5 | 7 | 8 | 49 | 40.8 | 59.1 | 46 | 50.0 | 45.1 |

It will be appreciated that an IDC modular jack has been described which not only affords low crosstalk but is also easily interchangeable with other jacks to facilitate use of conventional parts or tooling in its production and use.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An insert for a modular jack comprising:

(a) an insulative member comprising a base section having a first and second end and an angular section extending approximately perpendicularly from the base section;

(b) a first conductive element extending in a first plane perpendicularly into the base section of the insulative member adjacent the first end of said base section and then extending longitudinally through said base section and then extending perpendicularly into the angular section of the insulative member in a second plane;

(c) a second conductive element extending in the first plane perpendicularly into the base section of the insulative member and then extending longitudinally through said base section and then extending perpendicularly into the angular section of the insulative member in a third plane; and (d) a third conductive element extending in a fourth plane perpendicularly into the base section of the insulative member adjacent the second end of the base section and then extending into the angular section of the insulative member in the second plane.

2. The insert of claim 1 wherein a fourth conductive element extends in the fourth plane perpendicularly into the base section of the insulative member and then extends into the angular section of the insulative member in the third plane.

3. The insert of claim 1 wherein the first, second, third and fourth conductive elements each comprise at least one terminal.

4. The insert of claim 1 wherein the first, second, third and fourth conductive elements comprise eight terminals, and in adjacent order the first plane includes terminals 1, 2, 5, and 4.

5. The insert of claim 1 wherein the first, second, third and fourth conductive elements comprise eight terminals, and the second plane includes terminals 2, 5 and 6.

6. The insert of claim 1 wherein the first, second, third and fourth conductive elements comprise eight terminals, and the third plane includes contacts 1, 3, 5, 7 and 8.

7. The insert of claim 1 wherein the first, second, third and fourth conductive elements comprise eight terminals, and the fourth plane includes terminals 3, 6, 7 and 8.

8. The insert of claim 2 wherein in the first and fourth planes each of the conductive elements are insulation displacement contacts.

9. The insert of claim 2 wherein the conductive elements in the second plane have an oblique extension toward the base section.

10. The insert of claim 2 wherein the conductive elements in the third plane are arcuate.

11. The insert of claim 2 wherein an insulative cover is superimposed over the angular section and one side of the base section of the insulative member.

12. The insert of claim 2 wherein the insulative displacement contacts are laterally surrounded by an insulative housing.

13. A modular jack comprising:

(a) an insert for a modular jack comprising:

(i) an insulative member comprising a base section having a first and second end and an angular section extending approximately perpendicularly from the base section;

(ii) a first conductive element extending in a first plane perpendicularly into the base section of the insulative member adjacent the first end of said base section and then extending longitudinally through said base section and then extending perpendicularly into the angular section of the insulative member in a second plane;

(iii) a second conductive element extending in the first plane perpendicularly into the base section of the insulative member and then extending longitudinally through said base section and then extending perpendicularly into the angular section of the insulative member in a third plane; and (iv) a third conductive element extending in a fourth plane perpendicularly into the base section of the insulative member adjacent the second end of the base section and then extending into the angular section of the insulative member in the second plane;

(b) an insulative cover superimposed over the angular section and one side of the base section of the insulative member; and (c) an insulative housing laterally surrounding the insulative displacement contact.

14. The modular jack of claim 13 wherein a fourth conductive element extends in the fourth plane perpendicularly into the base section of the insulative member and then extends into the angular section of the insulative member in the third plane.

15. The modular jack of claim 13 wherein in the first and fourth planes each of the conductive elements are insulation displacement contacts.

16. The modular jack of claim 13 wherein the conductive elements in the second plane have an oblique extension toward the base section.

17. The modular jack of claim 13 wherein the conductive elements in the third plane are arcuate.

18. The modular jack of claim 13 wherein an insulative cover is superimposed over the angular section and one side of the base section of the insulative member.

19. The modular jack of claim 13 wherein the insulative displacement contacts are laterally surrounded by an insulative housing.

20. The modular jack of claim 14 wherein the first, second, third and fourth conductive elements each comprise at least one terminal.

21. The modular jack of claim 20 wherein in adjacent order the first plane includes terminals 1, 2, 5, and 4.

22. The modular jack of claim 21 wherein the second plane includes terminals 2, 5 and 6.

23. The modular jack of claim 22 wherein the third plane includes contacts 1, 3, 5, 7 and 8.

24. The modular jack of claim 23 wherein the fourth plane includes terminals 3, 6, 7 and 8.

* * * * *